US005950940A

United States Patent [19]

Hoof et al.

[11] Patent Number: 5,950,940

[45] **Date of Patent: *Sep. 14, 1999**

[54] APPARATUS FOR COMMINUTING SHEET METAL OR SIMILAR MATERIAL

[75] Inventors: Erhard Hoof; Frank Hoof, both of Eschweiler, Germany

[73] Assignee: Albert Hoffmann GmbH, Eschweiler, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/814,271

[22] Filed: Mar. 10, 1997

[30] Foreign Application Priority Data

Mar. 11, 1996 [DE] Germany ..... 196 09 347

[51] Int. Cl.[6] ..... B02C 13/286

[52] U.S. Cl. ..... 241/73; 241/189.1

[58] Field of Search ..... 241/73, 88.4, 88, 241/89.2, 89.3, 189.1

[56] References Cited

U.S. PATENT DOCUMENTS

| | | |
|---|---|---|
| 2,946,523 | 7/1960 | Phillips . |
| 4,061,277 | 12/1977 | Whitney . |
| 4,378,756 | 4/1983 | Whitemann . |
| 5,150,844 | 9/1992 | McKie . |

FOREIGN PATENT DOCUMENTS

| | | |
|---|---|---|
| 1577769 | 5/1977 | United Kingdom . |
| 2068260 | 12/1980 | United Kingdom . |

*Primary Examiner*—Mark Rosenbaum
*Attorney, Agent, or Firm*—Henry M. Feiereisen

[57] ABSTRACT

Apparatus for comminuting sheet metal or similar material, includes a striking tool rotatably supported about an axis; and an enveloping deck in the form of a grate assembly having holes formed therein or an abrasive plate assembly having depressions formed therein, with the enveloping deck interacting with the striking tool for crushing a material. The holes or the depressions are so arranged as to define a web structure which at least in direction of the axis has a pattern that deviates from a straight line.

16 Claims, 2 Drawing Sheets

APPARATUS FOR COMMINUTING SHEET METAL OR SIMILAR MATERIAL

BACKGROUND OF THE INVENTION

The present invention refers to an apparatus for comminuting sheet metal or similar material, and in particular to a crusher having a housing frame for supporting a rotor, formed as a striking tool, for rotation about an axis and interacting with an enveloping deck in the form of a grate assembly provided with holes or an abrasive plate assembly provided with depressions.

An apparatus of this type, including hammer mills, are typically used for crushing scrap of motor vehicles. Generally, the material is fed via a sloped track into the rotor compartment of the crusher and subsequently comminuted and pulverized between the striking tool and the enveloping deck. In a hammer mill, material is crushed by a plurality of hammers which are secured on the rotating rotor, and is subsequently ejected from the mill through holes formed in the grate assembly.

Abrasive plates may also be utilized in combination with the grate assembly in mills, sifters, sorters and processing plants, and either cast or made from rolled sheet metal. At operation, the enveloping deck, i.e. abrasive plates or grates are subject to extremely high stress by the material being comminuted which transmits forces onto the abrasive plates from different directions. In particular, certain areas of the housing bottom are subject to maximum stress as a result of frictional loads, crushing action and pressure loads generated between the bottom and the hammers. Thus, single grates or abrasive plates are subject to a comparably greater wear and have a reduced service life as other parts of the deck. This wear as a result of the great force transmitted by the striking tool onto the grates or abrasive plates causes a stretching of the grates and abrasive plates and lead to an elongation of the holes or depressions. This expansion of the grates and abrasive plates impairs their attachment to the apparatus and especially complicates a dismantling thereof. A dismantling is frequently required when the grates or plates become wedged in the apparatus. When this happens, the grates or plates can be dismantled only through use of a welding torch which usually results in a complete destruction of these parts. A desired, frequent replacement of the grates or plates for producing different materials, i.e. exchange of only partially worn out plates for later reuse and for variation of the hole sizes is not possible to date.

SUMMARY OF THE INVENTION

It is an object of the present invention to provide an improved apparatus for comminuting material, obviating the afore-stated drawbacks.

In particular, it is an object of the present invention to provide an improved apparatus for comminuting material in such a manner that an elongation of the grates or the abrasive plates is minimized during operation.

These objects and others which will become apparent hereinafter are attained in accordance with the present invention by so positioning the holes in the grates or depressions in the abrasive plates that a web structure is defined which has a pattern that deviates at least in axial direction of the striking tool from a straight line.

The present invention is based on the recognition that the elongation of the abrasive plates or grates is dependent on the plate geometry so that a particular configuration of the holes or depressions is capable of reducing or minimizing the elongation. As the webs, defined between the holes or depressions, deviate from a straight line, an elongation of the webs does not necessarily result in an elongation of the enveloping deck but may cause only deformations within the grate or the abrasive plate that do not affect the overall dimensions of the grate or the abrasive plate.

Formation of only some nonllinear webs in the grates or plates already leads to an appreciable decrease of the elongation during use. Preferably, the webs are so formed that their pattern in direction of the axis of the striking tool as well as transversely thereto deviates from a straight line. Thus, grates or plates positioned in axial direction of the striking tool exert smaller forces during operation onto the lateral marginal areas of the apparatus, while a reduced elongation transversely to the rotor axis facilitates the replacement of neighboring grates or plates.

Preferably, the holes in the grates or the depressions in the plates are offset to one another and of substantially hexagonal configuration. This is advantageous because in each junction point only three webs come together. The particular configuration of the holes or depressions in the grates or plates, respectively, thus results in a highly cost-efficient production. In contrast thereto, conventional decks have square holes or depressions so that four webs meet in each junction point. This however is disadvantageous in connection with casting processes.

The enveloping deck in accordance with the present invention interacts with the striking tool which travels along a straight line relative to the holes, such that the striking tool passes alternately over holes and webs, thereby greatly improving the stability of the apparatus.

According to another feature of the present invention, the holes or depressions in a peripheral area of the deck exhibit a pentagonal configuration and are so shaped as to cover a same feedthrough area as the hexagonal holes or depressions in a central region of the deck. The formation of pentagonal holes or depressions in the peripheral area permits a straight and clean edge termination of the deck while still allowing a passage of similar sized parts as the hexagonal holes in the central region.

In accordance with variation of the present invention, the holes or depressions exhibit a round configuration in offset relationship to one another. Round holes facilitate a casting operation and with respect to length properties of the abrasive plate or grate have the same advantage as hexagonal holes. Suitably, in the peripheral area of the deck, the round holes are so configured adjacent to the edge as to exhibit a straight line. Thus, it is possible to extend the holes to the peripheral area of the deck and to so form the holes as to exhibit in the peripheral area the same feedthrough area as the holes in the central area of the deck.

As the configuration of the web structure according to the present invention effectively results in a decrease of the elongation of the deck, it is possible in accordance with another feature of the present invention to arrange the grate assembly transversely to the axis of the striking tool.

Advantageously, the grates may have holes which decrease in size in direction transversely to the axis. This configuration alters the grinding behavior, and in particular in conjunction with ceiling grates of hammer mills prevents a fallback or return of comminuted material into the work zone of the striking tool.

According to yet another feature of the present invention, the grate assembly is so supported within housing frame as to extend parallel to the rotor axis and slanted to a tangent oriented with respect to a path traveled by the striking tool.

Such an arrangement also alters the grinding behavior and results especially in the area of the ceiling grate in an enhanced guidance of material passing through the grate.

Grates or abrasive plates according to the present invention can be made of steel with high wear resistance, e.g. austenitic steel, because the particular geometry of the grate and plate subjects them to much less elongation compared to conventional abrasive plates or grates, so that the use of such materials is now possible.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
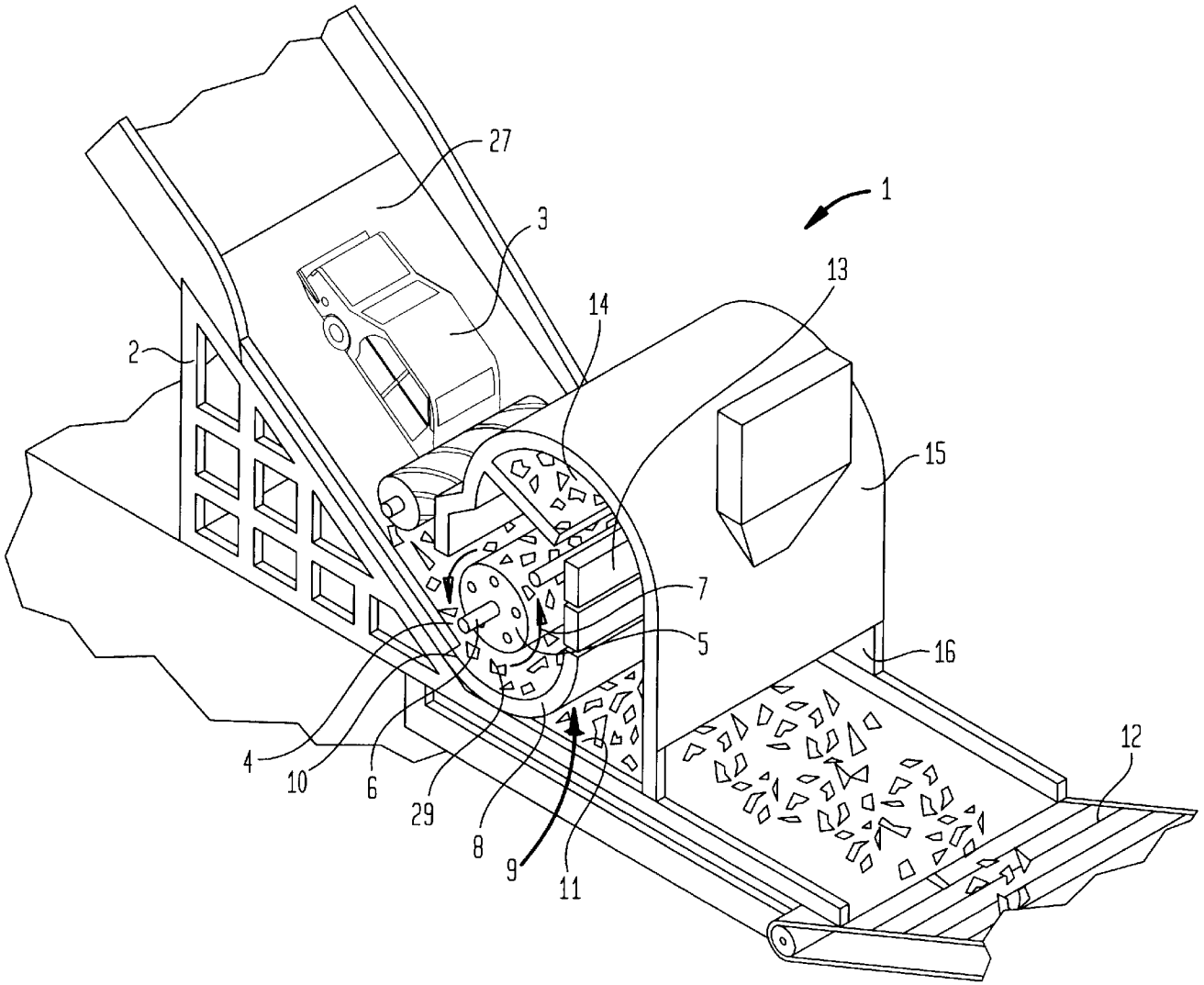
FIG. 1 is a simplified, schematic perspective illustration of a hammer mill according to the present invention.

Throughout all the Figures, the same or corresponding elements are generally indicated by the same reference numerals.

Turning now to the drawing, and in particular to FIG. 1, there is shown a simplified, schematic perspective illustration of a hammer mill according to the present invention, generally designated by reference numeral 1. The hammer mill 1 has a framework 2 which is so configured at the left side as to form a ramp 27 which terminates in a rotor compartment 4. Material to be comminuted such as sheet metal, or motor vehicles 3, slide down the ramp 27 to enter the rotor compartment 4. Received in the rotor compartment 4 is an exemplified rotor in the form of a striking tool 5 which is supported by the framework 2 for rotation about an axis 6. The striking tool 5 is driven by a motor (not shown) to travel in a direction indicated by arrows 7 and crushes the motor vehicle 3 in conjunction with a deck, generally designated by reference numeral 9 to produce crushed parts 8. The deck 9 envelopes the striking tool 5 in a semicircular manner and may be formed completely by a grate assembly or may also include abrasive plates in suitable disposition. For sake of simplicity, the nonlimiting example of FIG. 1 shows the deck 9 in the form of a grate assembly which includes a bottom grate 29, an ejection door 13 which continuous the bottom grate 29 in direction of arrow 7 and terminates in a ceiling grate 14. The ejection door 13 is provided to enable a discharge during crushing operation of exploding parts that can be generated during spark formation or gas formation.

The grate assembly 9 has formed therein holes 10, with the crushed parts 8 being pulverized along the edges of the holes 10 and subsequently, after being of small enough size, passing through the holes 10 to drop onto a subjacent chute 11 that transports the scrap parts 8 out of the hammer mill 1 and onto a conveyor belt 12.

A hood 15 with lateral shield 16 is secured to the framework 2 and extends around the grate assembly 9 at a distance thereto to direct scrap 8 passing through the grate assembly 9 toward the chute 11.

As shown in FIG. 1, the bottom grate 29 extends transversely to the axis 6 of the striking tool 5 so that an elongation of the bottom grate 29 does not affect the lateral shield 16 of the hood 15.

Figure 2A:
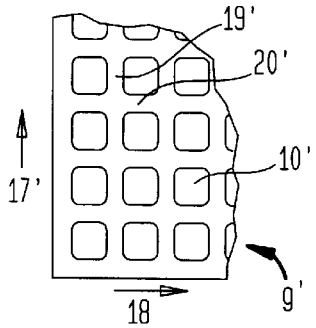
FIG. 2A (PRIOR ART)
FIG. 2*a* is a cutaway view of a conventional deck.

Turning now to FIG. 2*a*, there is shown a cutaway view of a grate (bottom grate, ejection door or ceiling grate) of a conventional grate assembly 9' which is formed with a symmetric disposition of square holes 10' in longitudinal and transverse directions to define webs 19', 20'. During extended use of the grate 9', these webs 19', 20' cause an elongation of the grate 9' in direction of arrow 17.

Figure 2B:
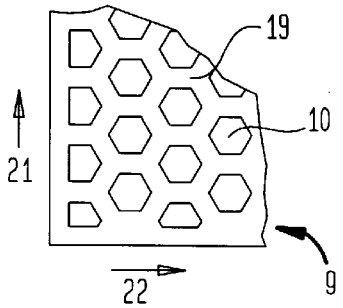
FIGS. 2*b* to 2*h* show cutaway views of various embodiments of a deck in accordance with the present invention.

In order to prevent elongation in both directions, the deck 9 has a grate assembly which, according to the cutaway plan view of FIG. 2*b*, has formed therein holes 10 exhibiting a hexagonal configuration and so positioned in an offset relation as to define webs 19 which deviate from a straight line in longitudinal direction as well as transverse direction. Such a configuration is applicable for the bottom grate 29, ejection door 13 and ceiling grate 14. In a peripheral area of the grate assembly 9, the holes 10 exhibit a pentagonal configuration and so configured as to cover a same area as the hexagonal holes in a central or inside area.

Figure 2C:
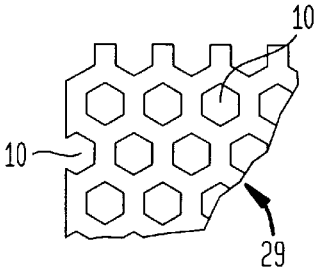
Figure 2D:
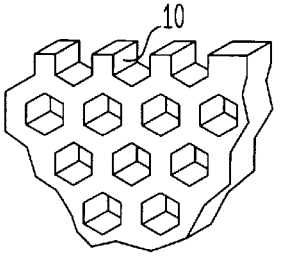

FIG. 2*c* shows a cutaway plan view and FIG. 2*d* a perspective view of an exemplified bottom grate 29 according to the present invention in which the holes 10 in the peripheral area are open towards the outside and are so configured as to cover a same feedthrough area as the hexagonal holes 10 in a central or inside area.

Figure 2E:
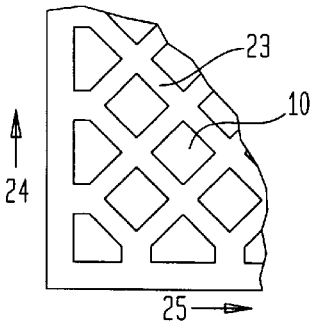

FIG. 2*e* shows a cutaway plan view of a grate 9 in which the holes 10 are so configured as to define webs 23 which extend diagonally to the grate 9 so as to form a zigzag line in longitudinal direction, indicated by arrow 24, as well as in transverse direction, indicated by arrow 25. The holes 10 exhibit a diamondshaped configuration, with the holes 10 in the peripheral area being so configured to suitably continue the established pattern.

Figure 2F:
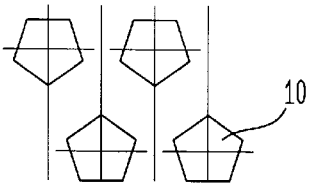

FIG. 2*f* shows a schematic illustration of pentagonal holes 10 which can also be so positioned as to form webs that define a zigzag line in longitudinal and transverse directions relative to the grate 9.

Figure 2G:
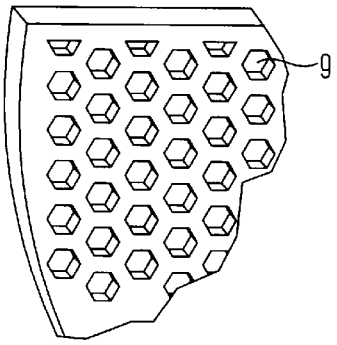

FIG. 2*g* shows a cutaway, perspective view of a grate 9 which extends transversely to the rotor axis and has formed therein hexagonal holes 10.

Figure 2H:
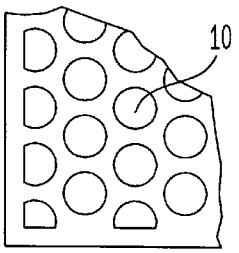

FIG. 2*h* shows a cutaway plan view of a grate 9 in which the holes 10 are of round configuration in offset relation, with the holes 10 in the peripheral area exhibiting a straight line adjacent the edge of the deck.

It is to be understood that the principles described in the preceding description with respect to a grate assembly are generally applicable to abrasive plates which may be incorporated in the deck and have formed therein depressions, instead of holes, to effect a comminution in conjunction with the striking tool.

While the invention has been illustrated and described as embodied in an apparatus for comminuting sheet metal or similar material, it is not intended to be limited to the details shown since various modifications and structural changes may be made without departing in any way from the spirit of the present invention.

What is claimed as new and desired to be protected by Letters Patent is set forth in the appended claims:

1. A hammer mill for comminuting sheet metal or other metallic material, comprising:

a striking tool rotatably supported about a generally horizontal axis; and an enveloping deck interacting with the striking tool for crushing a material, said enveloping deck including a plurality of grates so arranged in succession as to circumscribe a major portion of the striking tool, with one of the grates being so positioned in an area above the striking tool as to entirely cover the striking tool, said enveloping deck exhibiting a web structure which at least in direction of the axis has a pattern that deviates from a straight line to thereby resist an elongation of the enveloping deck during operation through deformation of the web structure.

2. The hammer mill of claim 1 wherein each of the grates has formed therein a hole arrangement to define the web structure for allowing crushed material to be discharged from a space between the striking tool and the enveloping deck to the outside.

3. The hammer mill of claim 2 wherein the enveloping deck includes an abrasive plate which has formed therein a depression arrangement to define the web structure.

4. The hammer mill of claim 3 wherein the depression arrangement has depressions positioned in offset relationship to one another and includes first depressions of substantially hexagonal configuration.

5. The apparatus of claim 4 wherein each plate has a peripheral area formed therein with second depressions of pentagonal configuration and so configured as to cover an area which corresponds to an area covered by the first hexagonal depressions.

6. The hammer mill of claim 3 wherein the depression arrangement has depressions positioned in offset relationship to one another and including first depressions of round configuration.

7. The apparatus of claim 6 wherein each plate has a peripheral area formed therein with second depressions of semicircular configuration with one side bounded by a straight line.

8. The hammer mill claim 3 wherein the abrasive plate is made of austenitic steel.

9. The hammer mill of claim 2 wherein the hole arrangement has holes positioned in offset relationship to one another and includes first holes of substantially hexagonal configuration.

10. The hammer mill of claim 9 wherein each grate has a peripheral area formed therein with second holes of pentagonal shape and so configured as to cover an area which corresponds to an area covered by the first hexagonal holes.

11. The apparatus of claim 2 wherein the hole arrangement has holes positioned in offset relationship to one another and including first holes of round configuration.

12. The hammer mill of claim 11 wherein each grate has a peripheral area formed therein with second holes of semicircular configuration with one side bounded by a straight line.

13. The hammer mill of claim 2 wherein the grates of the enveloping deck are disposed transversely to the axis of the striking tool.

14. The hammer mill of claim 2 wherein the hole arrangement of the grates has holes so extending transversely to the horizontal axis of the striking too as to expand in a direction toward the outside.

15. The hammer mill of claim 2, and further comprising a framework for so supporting the grates as to extend parallel to the axis of the striking tool and slanted to a tangent relative to a path traveled by the striking tool.

16. The hammer mill of claim 2 wherein the grates are made of austenitic steel.

* * * * *